US007334819B2

(12) United States Patent
Silverman

(10) Patent No.: US 7,334,819 B2
(45) Date of Patent: Feb. 26, 2008

(54) ADJUSTABLE BOOK COVER

(75) Inventor: Robert S. Silverman, Long Beach, CA (US)

(73) Assignee: Kittrich Corporation, La Mirada, CA (US)

( * ) Notice: Subject to any disclaimer, the term of this patent is extended or adjusted under 35 U.S.C. 154(b) by 0 days.

(21) Appl. No.: 11/224,505

(22) Filed: Sep. 13, 2005

(65) Prior Publication Data

US 2007/0085329 A1 Apr. 19, 2007

(51) Int. Cl.
*B42D 3/00* (2006.01)

(52) U.S. Cl. ..... 281/29; 281/34; 281/19.1

(58) Field of Classification Search ..... 281/15.1, 281/29, 31, 36, 34, 19.1, 17, 35, 20, 51; 412/24; 283/64

See application file for complete search history.

(56) References Cited

U.S. PATENT DOCUMENTS 1,479,791 A * 1/1924 Degenring ..... 281/34
1,595,002 A * 8/1926 Davis ..... 281/42
2,753,194 A * 7/1956 Correa ..... 281/34
3,222,085 A * 12/1965 Young ..... 281/34
4,519,630 A * 5/1985 Holmes ..... 281/31
4,715,619 A * 12/1987 Sloot ..... 281/19.1
4,744,592 A 5/1988 Barnette et al.
4,893,979 A 1/1990 Alpers
5,004,514 A 4/1991 Pugliese et al.
5,056,663 A * 10/1991 Ostrowski ..... 206/424
5,219,437 A * 6/1993 Moor et al. ..... 281/29

* cited by examiner

*Primary Examiner*—Monica Carter
*Assistant Examiner*—J Williams
(74) *Attorney, Agent, or Firm*—Patent Metrix

(57) ABSTRACT

An adjustable book cover (10) comprising a front cover (12) and a rear cover (30) that is integrally attached to the front cover (12). A front cover retaining pocket (48) is attached to the front cover's inner surface (24), and a rear cover retaining member (70) is attached to the rear cover's inner surface (42). Attachment means (92) are located on the rear cover's inner surface (42) and the retaining member's outer surface (80). The book cover (10) is dimensioned so that when the book cover (10) is placed on a book (100), the rear cover's left edge (36) can be folded inward, which allows the attachment means (92) on the rear cover's inner surface (42) to interface with the attachment means (92) on the retaining member's outer surface (80). The rear cover's left edge (36) can be folded inward various distances to accommodate books of different thickness.

5 Claims, 5 Drawing Sheets

ADJUSTABLE BOOK COVER

TECHNICAL FIELD

The invention pertains to the general field of book covers, and more particularly to a single, adjustable book cover that can be utilized on books of varying thickness.

BACKGROUND ART

The practice of writing information on a piece of paper and arranging groups of similar information together in a book type form has been in use since the invention of paper by Ts' Al Lun in the first century A.D. But it was not until the fifteenth century, when Johann Gutenberg invented printing from movable type, that books became available for common men and women. Movable type printing allowed books to be printed quickly, in greater numbers, and sold for a price that people other than the wealthy only could afford.

At first, the only book that may governments would allow to be printed was the bible, in the fear that if the lower classes read other material they would become influenced (and educated), and revolt. While it is true that certain books have led to civil disobedience and even rebellion, the positive benefits books have provided far outweigh the negative.

Today, in the western world there are basically two classes of books: recreational books and educational reference books. As a generalization, recreational books are those read for pleasure and can be commonly found in paperback form. Educational/reference books are usually used by students or professionals in a certain field to learn about a specific topic or topics.

What all books have in common, though, is that they are constructed with a front cover and a rear cover, with pages in-between. Paperback books, as their name implies, use covers that are made of a lightweight cardboard material. Educational/reference books are usually hardcover books, with significantly thicker and stronger covers. Regardless of the type utilized, book covers are often subjected to damage. This is especially true for paperback covers which are easily torn, bent or even removed from the book binding.

The easiest and most efficient way to protect a book is to use a book cover. Book covers are available in many sizes and styles, and school children are often taught how to make book covers out of paper bags. The major drawback to book covers though is that a single cover must be made for each book. Additionally, book covers cause any writing on the books' cover, such as the book's title, to be hidden. If a person has numerous books that are all covered with identical covers, it is difficult to distinguish each book.

Obviously, if there was a single book cover that could be utilized for multiple thickness books it would be beneficial. Fortunately, especially among paperback books, there is a common size factor for the book's width and length. Therefor, if a single book cover could be made that would accommodate books of various thickness, and utilize materials and/or designs that would allow a person to easily identify the book, the benefits would be significant.

A search of the prior art did not disclose any literature or patents that read directly on the instant invention. However, the following U.S. patents are considered related:

| PATENT NO. | INVENTOR | ISSUED |
|---|---|---|
| 5,004,514 | Pugliese, et al | 2 Apr. 1997 |
| 4,893,979 | Alpers | 16 Jan. 1990 |
| 4,744,592 | Barnette, et al | 17 May 1988 |

The U.S. Pat. No. 5,004,514 patent discloses a protective book covering including a relatively long piece of sheet material and a relatively short piece of sheet material overlying the long piece. The longitudinal edges of the two sheets are sealed together. A seal and tear line extending transverse to their longitudinal edges joins the two pieces and forms a line of severance along which the pieces can be torn to produce two units. Each unit has a pocket adjacent to the seal and tear line for accommodating one of the covers of a book. One of the units has a section, extending from the pocket of that unit, long enough to wrap around the spine of the book and be secured to the other unit.

The U.S. Pat. No. 4,893,979 patent discloses a supplemental cover for reinforcing a book having a spine, a first cover and a second cover. The supplemental cover consists of a first stiff sheet and a second sheet. The second sheet consists of a flexible region and a stiff region. The first sheet is adhered to the first cover of the book, and the flexible region of the second sheet is adhered to the spine of the book and the first sheet. The stiff region of the second sheet is adhered to the second cover of the book.

The U.S. Pat. No. 4,744,592 patent discloses a laminate and method for protecting books. The laminate consists of a stiff rectangular sheet adhered through a pressure sensitive adhesive to a thin flexible transparent rectangular sheet, which is of the same height as but wider than the stiff sheet. The two sheets are juxtaposed so that three edges of each sheet mutually coincide. The flexible sheet has a flexible rectangular side portion or extension to which the stiff sheet is not adhered. The stiff sheet is preferably of the same dimension as the book to be covered.

DISCLOSURE OF THE INVENTION

An adjustable book cover that is designed to be utilized on paperback and hardcover books of various thickness. The book cover is comprised of a front cover and an integrally attached rear cover. Located on the front cover's inner surface is a front cover retaining pocket, which is attached to the front cover's upper edge, lower edge and right edge. A rear cover retaining member is located on the rear cover's inner surface and is attached to the rear cover's upper edge and lower edge. Attachment means, preferably in the form of a hook and loop fastener, are attached to the rear cover's inner surface and the rear cover retaining member's outer surface.

The rear cover is dimensioned so that when the book cover is placed on a book, the rear cover can be folded inward, which allows the attachment means on the rear cover's inner surface to interface with the attachment means on the retaining member's outer surface. The distance that the rear cover is folded inward is determined by the thickness of the book being covered. When a relatively thin book is being covered, the rear cover is folded inward a greater distance than when a thicker book is being covered. This method assures that regardless of the book's thickness, the adjustable book cover will be tightly and securely maintained on the book.

In view of the above disclosure, the primary object of the invention to provide a single adjustable book cover that can provide a protective covering for paperback and hardcover books of various thickness.

It is also an object of the invention to provide a single, adjustable book cover that:

- can be made in various sizes to accommodate large or small books,
- can be made of various material to provide significant amounts of protection and/or various aesthetic appearances,
- can include indicia that identifies the book that is covered or that allows a person to customize his/her cover according to taste,
- can be quickly and easily attached and removed from a book, and
- is cost effective from both a manufacturer's and a consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
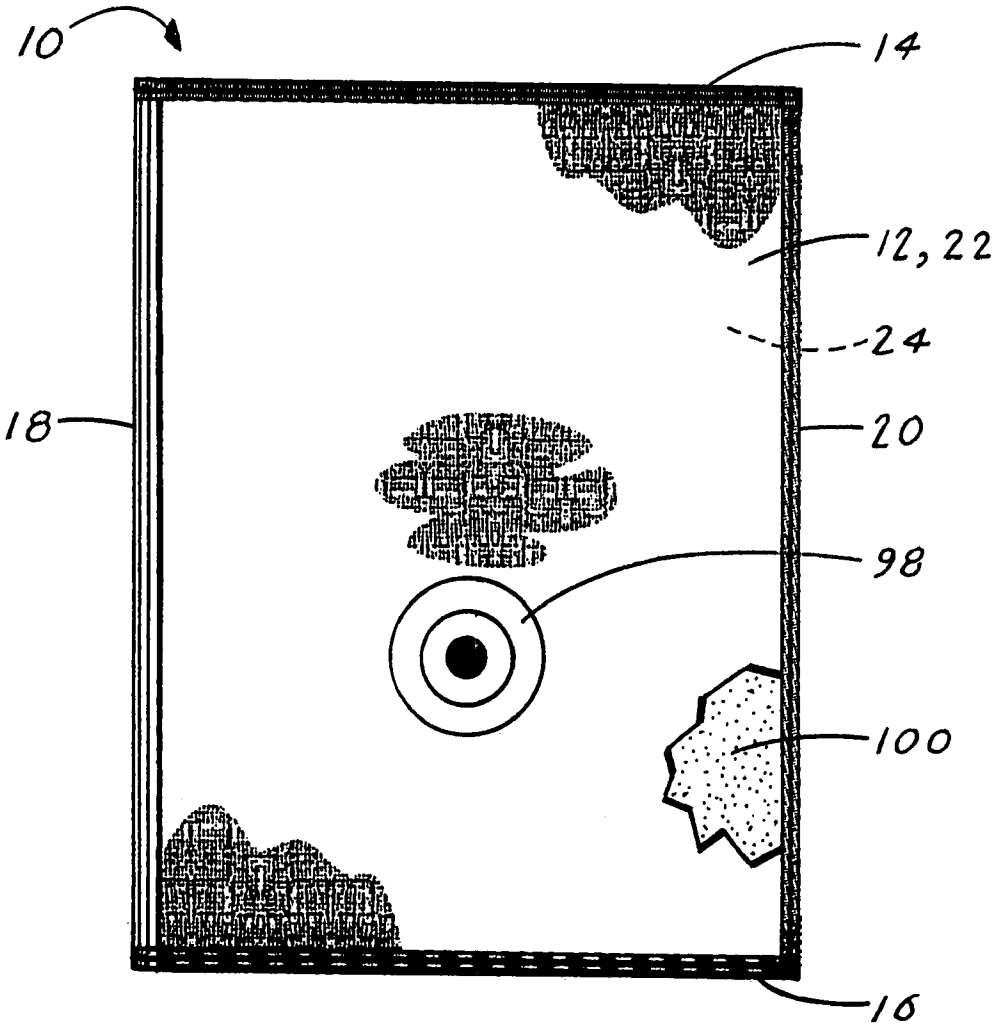
FIG. 1 is a front elevational view of the book cover in a closed position.

The best mode for carrying out the invention is presented in terms of a preferred embodiment for an adjustable book cover 10. The book cover 10 is designed to be utilized for paperback and hardcover books, but it is especially effective for paperback books as a result of paperback books having inherently weak front and rear covers. The primary benefit the inventive book cover 10 has over other conventional book covers is that a single book cover can be utilized for books of various thickness. The inventive book cover 10 provides a tight and secure protective covering for thin books with relatively smaller number of pages, and for thick books with significantly more pages. Obviously, a single book cover can not be utilized for all books, regardless of thickness, but the inventive book cover 10, as a result of its unique design, can accommodate many paperback and hardcover books. Additionally, the book cover 10 can be made in various sizes in order to cover books with large or small lengths and widths.

As shown in FIGS. 1-5, the adjustable book cover 10 is comprised of the following major elements: a front cover 12, a rear cover 30, a front cover retaining pocket 48, a rear cover retaining member 70 and attachment means 92. Additionally, in order to provide a complete description of the book cover 10, a book 100 is also referenced in the text and figures.

Figure 2:
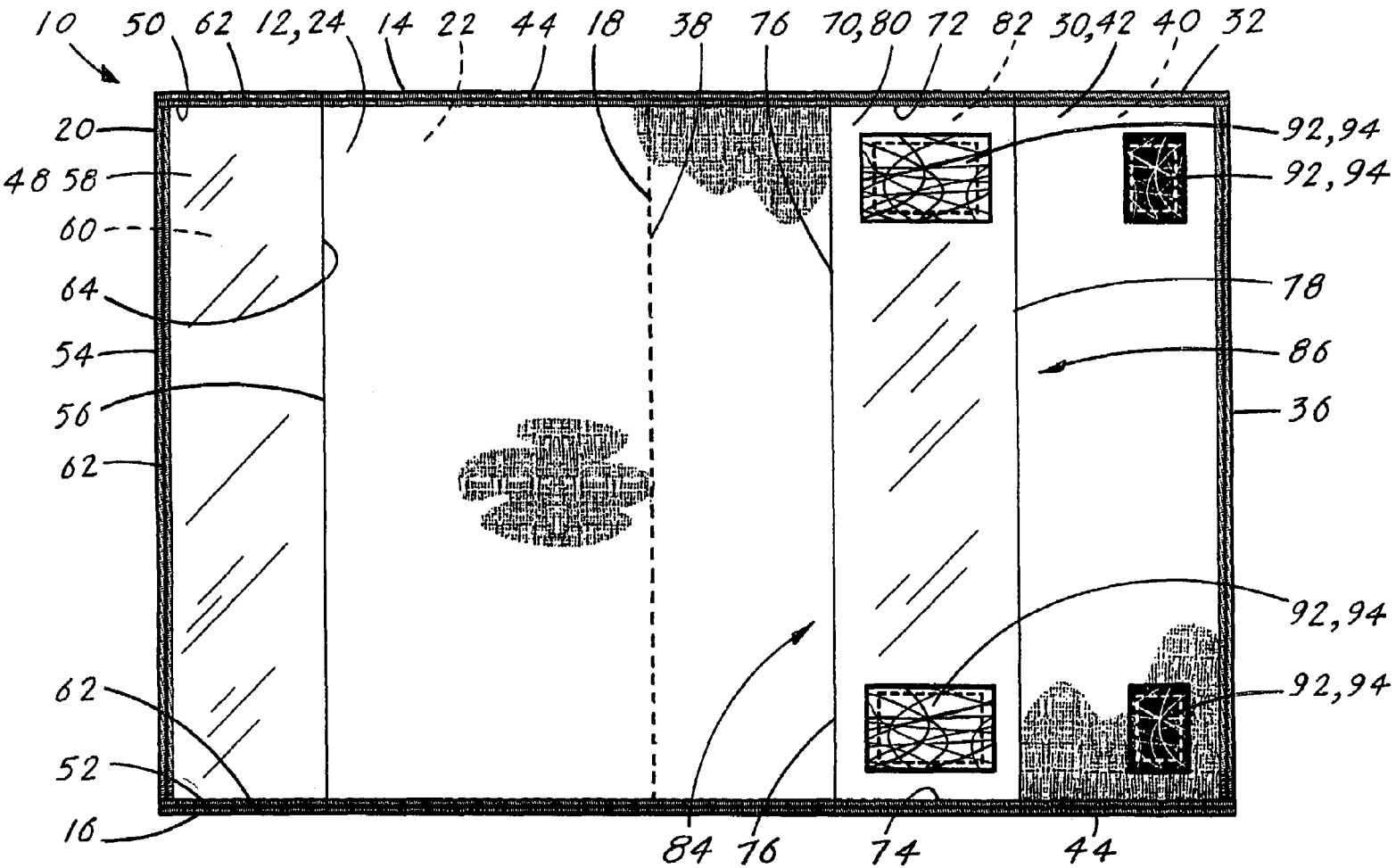
FIG. 2 is an inner elevational view of the book cover in an open position.
Figure 3:
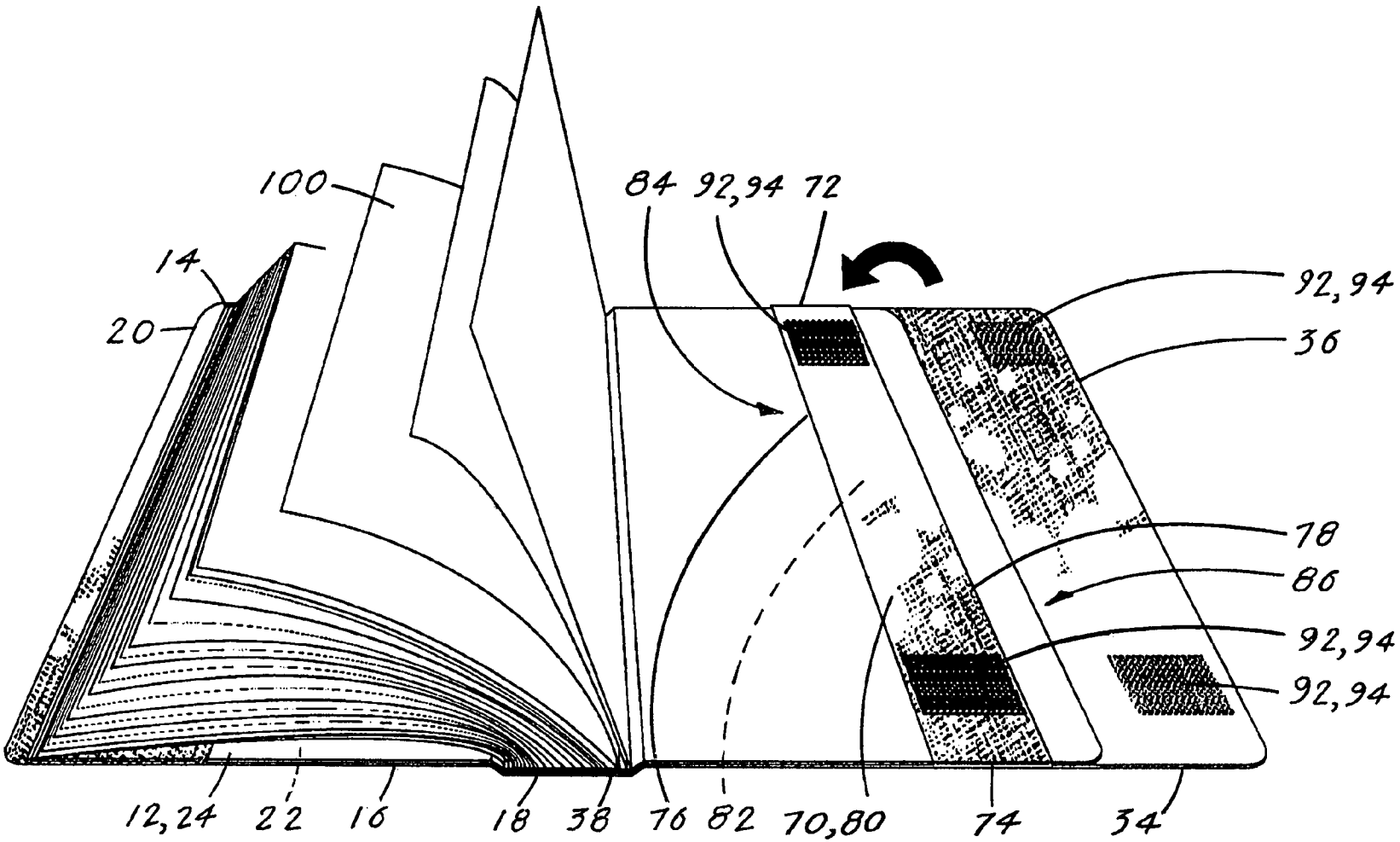
FIG. 3 is a perspective view of the book cover on a book showing how the attachment means interface.

As shown in FIGS. 1-3, the front cover 12 is comprised of an upper edge 14, a lower edge 16, a left edge 18, a right edge 20, an outer surface 22, and an inner surface 24.

Similarly, the rear cover 30 is also comprised of an upper edge 32, a lower edge 34, a left edge 36, a right edge 38, an outer surface 40, and an inner surface 42. As shown in FIGS. 2 and 3, the rear cover's right edge 38 is integrally attached to the front cover's left edge 18, thereby forming a single structure, adjustable book cover 10.

Both the front cover 12 and the rear cover 30 can be made of various materials. Typically, the material would be fabric, nylon or plastic. The front and/or rear covers 12,30 can be a single, solid color, or various images or artwork can be utilized to provide an improved aesthetic appearance. Indicia 98, as shown in FIG. 1, can also be applied to the front and/or rear covers 12,30, and the indicia can include anything from writing/words that identify the book that is covered, a person's or school's name, various animal prints, etc.

As shown in FIG. 2, the front and rear covers 12,30 can further comprise a stitched border 44 that extends along the front cover's upper edge 14, lower edge 16 and right edge 20, and the rear cover's upper edge 32, lower edge 34 and left edge 36. In addition to adding to the appearance of the book cover 10, the stitched border 44 also adds to the cover's 10 structural integrity.

As shown in FIG. 2, the front cover retaining pocket 48 is comprised of an upper edge 50, a lower edge 52, a left edge 54, a right edge 56, an outer surface 58, and an inner surface 60. The retaining pocket 48 is located on the front cover's inner surface 24 and is attached by an attachment means 62 to the front cover's upper edge 14, lower edge 16 and right edge 20. The attachment means 62 for attaching the retaining pocket 48 is comprised of stitching or an adhesive, with stitching preferred. The retaining pocket 48 is made from a material selected from the group consisting of fabric, solid plastic, transparent, translucent plastic or nylon. As also shown in FIG. 2, when the retaining pocket is attached, an opening 64 is created along the length of the pocket's 48 right edge 56.

As shown in FIG. 2, the rear cover retaining member 70 is comprised of an upper edge 72, a lower edge 74, a left edge 76, a right edge 78, an outer surface 80, and an inner surface 82. The retaining member 70 is located on the rear cover's inner surface 42 and is attached, by an attachment means, to the rear cover's upper edge 32 and lower edge 34. The attachment means utilized to attach the retaining member 70 to the rear cover's inner surface 60 are the same attachment means 62 that are utilized to attach the front cover retaining pocket 48 to the front cover's inner surface 24. Additionally, the rear cover retaining member 70 can be made of the same materials as the front cover retaining pocket 48. As also shown in FIG. 2, when the rear cover retaining member 70 is attached an opening 84 is created along the length of the retaining member's left edge 76 and an opening 86 is created along the length of the retaining member's right edge 78.

As shown in FIGS. 2 and 3, the attachment means 92 are located on the rear cover's inner surface 42 and on the rear cover retaining member's outer surface 80. The attachment means 92 are preferably comprised of a hook and loop fastener 94, which is known as VELCRO™, or snap buttons (not shown).

The rear cover 30 of the book cover 10 is dimensioned to allow the right edge 38 of the rear cover 30 to be folded inward. When the book cover 10 is placed on a book 100, the rear cover 30 is then folded over a distance that is allowed by the thickness of the book 100, as shown in FIG. 3. Once the rear cover 30 is folded over, the attachment means 92 interface, thereby securing the cover on the book 100.

Figure 4:
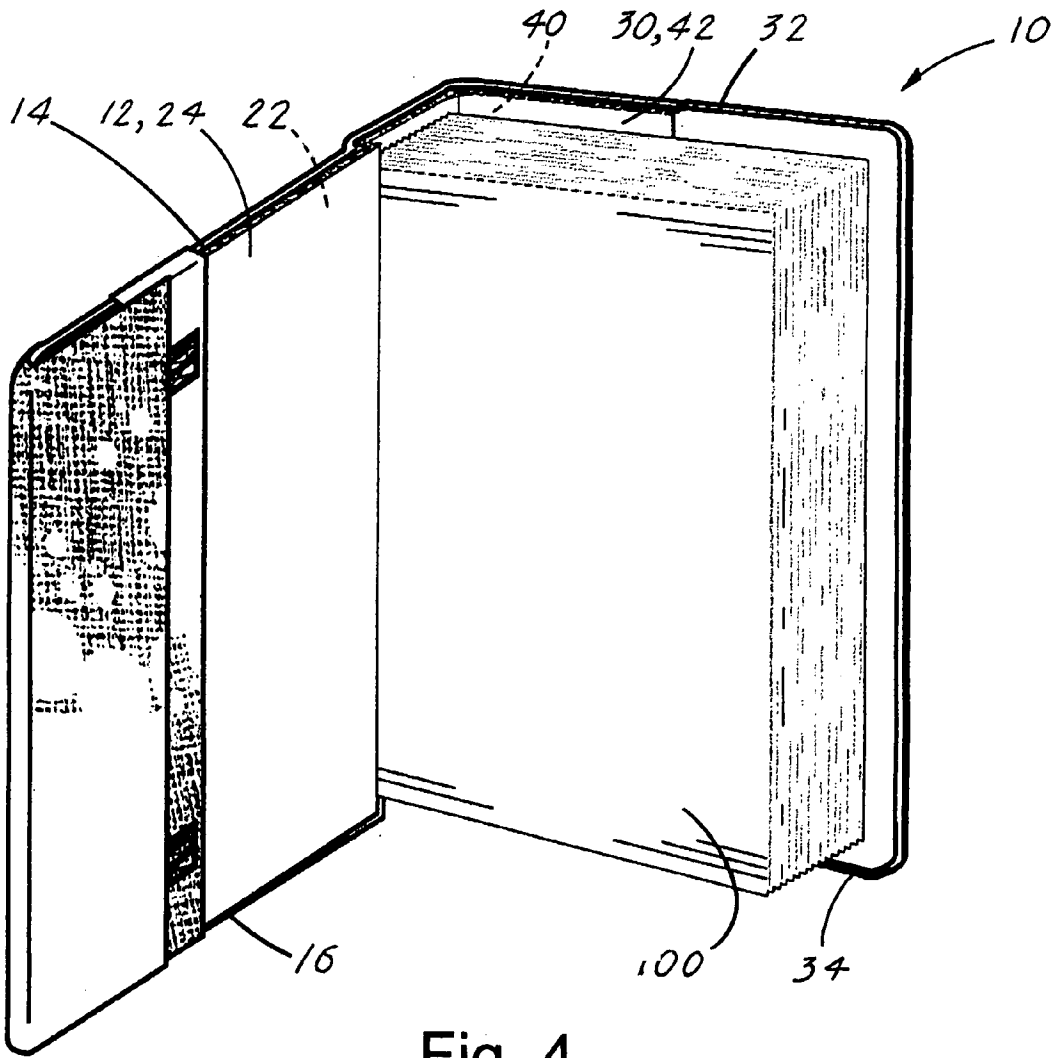
FIG. 4 is a perspective view of an alternative design of the book cover showing the front cover retaining pocket created by folding the front cover's right edge inward.

In an alternative design of the book cover 10, the front cover retaining pocket 48 can be created by extending the length of the front cover's right edge 20 and then folding the right edge 20 inward. The attachment means 62 are utilized to attach the folded section's upper edge to the front cover's upper edge 14, and the folded section's lower edge to the front cover's lower edge 16. With the folded section's upper and lower edges attached, the opening 64 for a book's front cover is created, as shown in FIG. 4.

Figure 5:
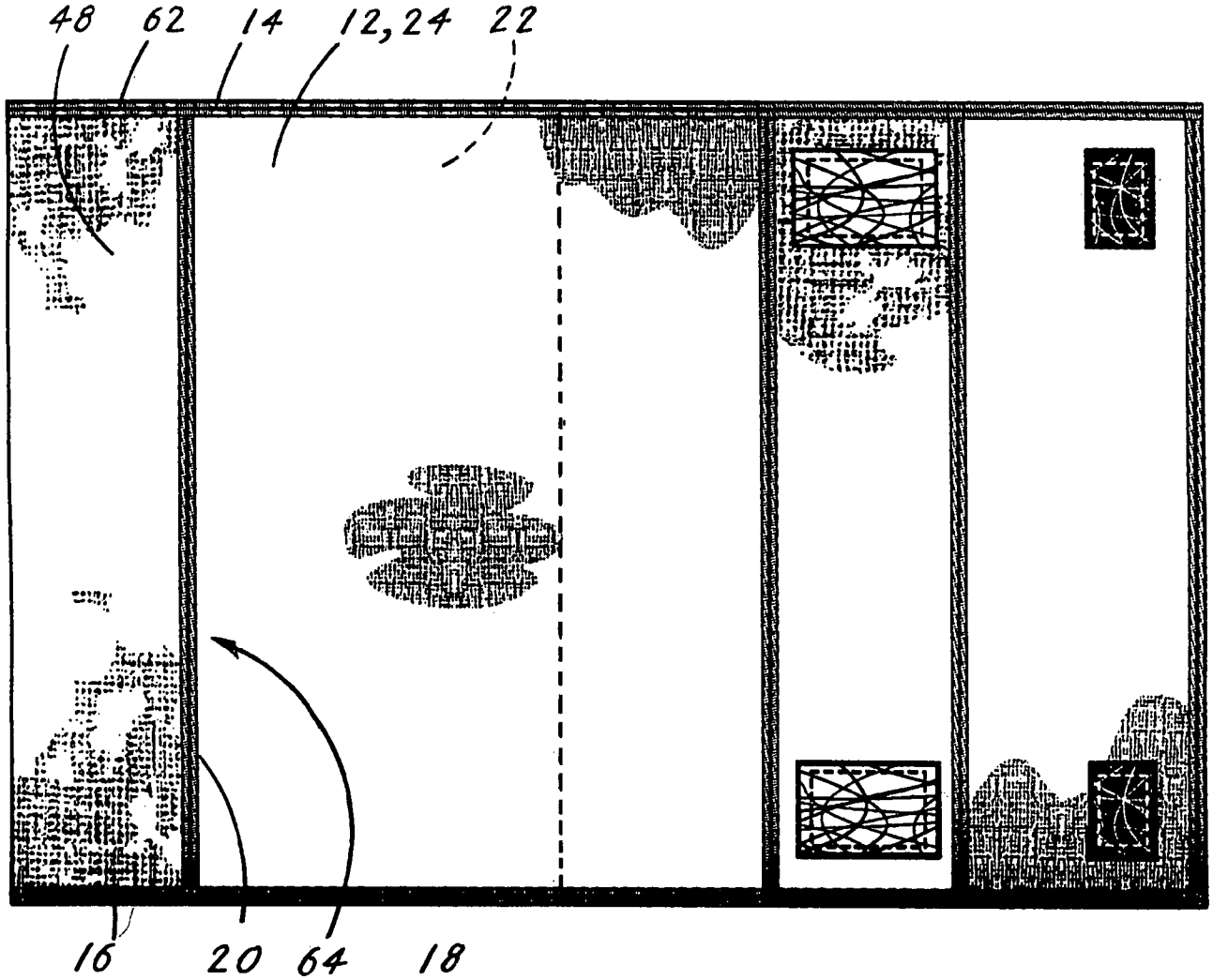
FIG. 5 is an inner elevational view of the book cover showing the front cover's right edge, as the means for securing the book within the book cover.

In order to provide the most effective disclosure of the adjustable book cover 10, the following steps are included which describe how to attach the book cover 10 onto a book 10. The first step is to place the book cover 10 on a flat surface, such as a table, with the front cover's inner surface 24 and the rear cover's inner surface 42 facing upward. The second step is to insert the front cover of the book 100 into the opening 64 that is located along the length of the front cover retaining pocket's right edge 56. The third step is to insert the rear cover of the book 100 into the opening 84 that is located along the length of the rear cover retaining member's left edge 76. The fourth, and final step is to fold inward the rear covers left edge 36 so that the attachment means 92 located on the rear cover's inner surface 42 interface with the attachment means 92 located on the retaining member's outer surface 80. The adjustable book cover 10 is designed so that the rear cover's left edge 36 can be folded inward by varying amounts to allow books of different thickness to be securely and completely covered. It should be noted that while this disclosure describes the book cover 10 utilizing the rear cover's left edge 36 as the means to secure a book 100 within the cover 10, the front cover's right edge 20 can also be utilized equally effectively, as shown in FIG. 5.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and cope of the claims.

The invention claimed is:

1. An adjustable book cover comprising a front cover, a rear cover that is integrally attached to the front cover, a front cover retaining pocket that is attached to the front cover's inner surface, a rear cover retaining member that is attached to the rear cover's inner surface, and attachment means that are located on the rear cover's inner surface and the retaining member's outer surface for securing the adjustable book cover on a book, wherein the rear cover is dimensioned so that when the book cover is placed on a book, the rear cover's right edge can be folded inward, which allows the attachment means on the rear cover's inner surface to interface with the attachment means on the retaining member's outer surface, thereby causing the adjustable book cover to be tightly and securely maintained on the book wherein said rear cover retaining member is comprised of an upper edge, a lower edge, a left edge, a right edge, an outer surface, an inner surface, wherein said retaining member is attached, by an attachment means, to the rear cover's inner surface along the upper edge and lower edge.

2. The adjustable book cover as specified in claim 1 wherein said rear cover retaining member is made of a material selected from the group consisting of fabric, solid plastic, transparent plastic and nylon.

3. The adjustable book cover as specified in claim 1 wherein the attachment means for attaching said rear cover retaining member to the rear cover's inner surface are selected from the group consisting of stitching, and adhesive.

4. An adjustable book cover comprising:

a) a front cover having an upper edge, a lower edge, a left edge, a right edge, an outer surface and an inner surface, b) a rear cover having an upper edge, a lower edge, a left edge, a right edge, an outer surface and an inner surface, wherein said rear cover's left edge is integrally attached to said front cover's right edge, thereby forming a single structure adjustable book cover, c) a front cover retaining pocket having an upper edge, a lower edge, a left edge, a right edge, an outer surface and an inner surface, wherein said front cover retaining pocket is located on the front cover's inner surface and is attached by an attachment means to the front cover's upper edge, lower edge and left edge, and wherein when said front cover retaining pocket is attached, an opening is created along the length of said pocket's right edge, d) a rear cover retaining member having an upper edge, a lower edge, a left edge, a right edge, an outer surface and an inner surface, wherein said rear cover retaining member is located on the rear cover's inner surface and is attached by an attachment means to the rear cover's upper edge and lower edge, and wherein when said rear cover retaining member is attached, an opening is created along the length of the retaining member's left edge and right edge, and e) rear cover attachment means that are located on the rear cover's inner surface and the rear cover retaining member's outer surface, wherein said rear cover is dimensioned to allow the right edge of the rear cover to be folded inward, and wherein when the adjustable book cover is placed on a book, the rear cover is then folded over a distance that is allowed by the size of the book, and wherein the attachment means that are located on the rear cover's inner surface interface with the attachment means that are located on the rear cover retaining member's outer surface, thereby causing the adjustable book cover to be tightly and securely maintained on the book.

5. The adjustable book cover as specified in claim 4 wherein said front cover's outer surface and said rear cover's outer surface comprise indicia selected from the group consisting of writing, words, names, or prints.

* * * * *